US006772960B2

(12) United States Patent
Speier

(10) Patent No.: US 6,772,960 B2
(45) Date of Patent: Aug. 10, 2004

(54) DOUBLE-SWIRL SPRAYING NOZZLE AND METHOD OF SPRAYING

(75) Inventor: Juergen Speier, Reutlingen (DE)

(73) Assignee: Lechler GmbH & Co. KG, Metzingen (DE)

( * ) Notice: Subject to any disclaimer, the term of this patent is extended or adjusted under 35 U.S.C. 154(b) by 337 days.

(21) Appl. No.: 09/902,620

(22) Filed: Jul. 12, 2001

(65) Prior Publication Data

US 2002/0020757 A1 Feb. 21, 2002

(30) Foreign Application Priority Data

Jul. 12, 2000 (DE) ..... 100 33 781

(51) Int. Cl.[7] ..... B05B 17/04; B05B 1/34

(52) U.S. Cl. ..... 239/11; 239/461; 239/463; 239/468; 239/548; 239/565

(58) Field of Search ..... 239/461, 463, 239/468, 548, 565, 11, 487

(56) References Cited

U.S. PATENT DOCUMENTS 545,320 A * 8/1895 Van Sickle ..... 239/468
2,484,577 A * 10/1949 Murphy ..... 239/468

FOREIGN PATENT DOCUMENTS

DE 19758526 A1 6/1999

* cited by examiner

*Primary Examiner*—Steven J. Ganey
(74) *Attorney, Agent, or Firm*—Crowell & Moring LLP

(57) ABSTRACT

A double-swirl spraying nozzle has two swirl chambers which are open toward opposite sides and are in each case arranged on respective sides of a longitudinal center plane extending through the inflow duct and are preferably designed mirror-symmetrically with respect to the center axis of the inflow duct. This design makes it possible for the medium to enter without any cross-sectional constrictions into the two swirl chambers and to exit with a different swirl in opposite directions.

24 Claims, 3 Drawing Sheets

DOUBLE-SWIRL SPRAYING NOZZLE AND METHOD OF SPRAYING

BACKGROUND AND SUMMARY OF THE INVENTION

This application claims the priority of German Patent Document 100 33 781.3, filed in Germany, July 12, 2000, the disclosure of which is expressly incorporated by reference herein.

The invention relates to a double-swirl spraying nozzle having two swirl chambers, which are open toward opposite sides, for generating oppositely exiting spraying jets with an opposite swirl, and having a common inflow duct for the medium to be sprayed.

Double-swirl spraying nozzles of this type are known from German Patent Document DE 197 58 526 A1. These double-swirl spraying nozzles have coaxially arranged swirl chambers with orifices directed in an offset manner. Such swirl spraying nozzles have the purpose of compensating the total swirl exercised by them, so that, if possible, no residual swirl will remain in a medium flowing past the nozzles.

Such nozzles generate the corresponding swirl after a deflection of the fed medium current in each case onto the exterior wall of the swirl space in each case not before the corresponding swirl space half, in which case the swirl space halves can also be separated by a plate with respect to the inflow duct. Both measures clearly restrict the free access cross-section. Also, energy is destroyed in the case of such nozzles with inserted swirl bodies.

It is an object of the present invention to construct a double-swirl spraying nozzle of the initially mentioned type such that the free access cross-section is not limited, without having to fear constructive disadvantages.

For achieving this object, it is provided according to the invention in the case of a double-swirl spraying nozzle of the initially mentioned type that the center axes of the swirl chambers are arranged on different sides of a center plane which extends through the inflow duct and parallel to the swirl chamber axes. As a result of this measure, particularly if the interiors of both swirl spaces are each situated on different sides of the center plane, the medium flows tangentially into the respective swirl chamber so that the velocity generated in the inflow can immediately be changed to a rotation. As a result of the arrangement of the swirl chambers according to the invention, a joint inflow bore can be used without any deflections and without requiring any special measures for generating the swirl. The reason is that, after its entrance, the medium flows in the manner of a free full jet to the opposite wall forming a nose directed against the jet, where it is divided into fractions for the swirl chambers situated side-by-side. As a result of the swirl spaces each offset toward the outside, it also becomes possible to also insert flow breakers into the now formed rearward bottoms, which flow breakers are similar to those of full-cone nozzles with a tangential approach flow, in order to obtain a double full-cone nozzle. As a result of the fact that, despite the large free inflow connection, the two swirl chambers are constructed more or less as separate nozzles, it also becomes possible to change the volume flows and the formation of the jet, including the achievable spraying angle if this should be desired. The new nozzle can therefore not just be used as a swirl compensation nozzle, as described, for example, in German Patent Document DE 197 36 761 A1.

As a further development of preferred embodiments of the invention, it can, in addition to the tangential arrangement of the inflow duct to both swirl chambers, also be provided that the bottoms of the swirl chambers are arranged in a sloped manner with respect to the other partial space. This has the advantage that, when the nozzle is switched off, still present medium can flow from the nozzle. An undesirable clogging or undesirable deposits are therefore avoided. In this case, the inflow duct may also be designed such that its bottom level does not rise from the inlet side to the swirl chamber which is open in the downward direction, so that, when the nozzle is switched off, no liquid remains standing also in the inflow duct. The exterior surfaces of the nozzles can also be constructed such that impacting medium flows off toward the outside. In a particularly simple manner, the swirl chambers in the inflow area of the medium can also be constructed in a mirror-inverted fashion with respect to the center axis of the inflow duct so that a swirl compensation will then also be possible as in the known construction.

Other objects, advantages and novel features of the present invention will become apparent from the following detailed description of the invention when considered in conjunction with the accompanying drawings.

DETAILED DESCRIPTION OF THE DRAWINGS

Figure 1:
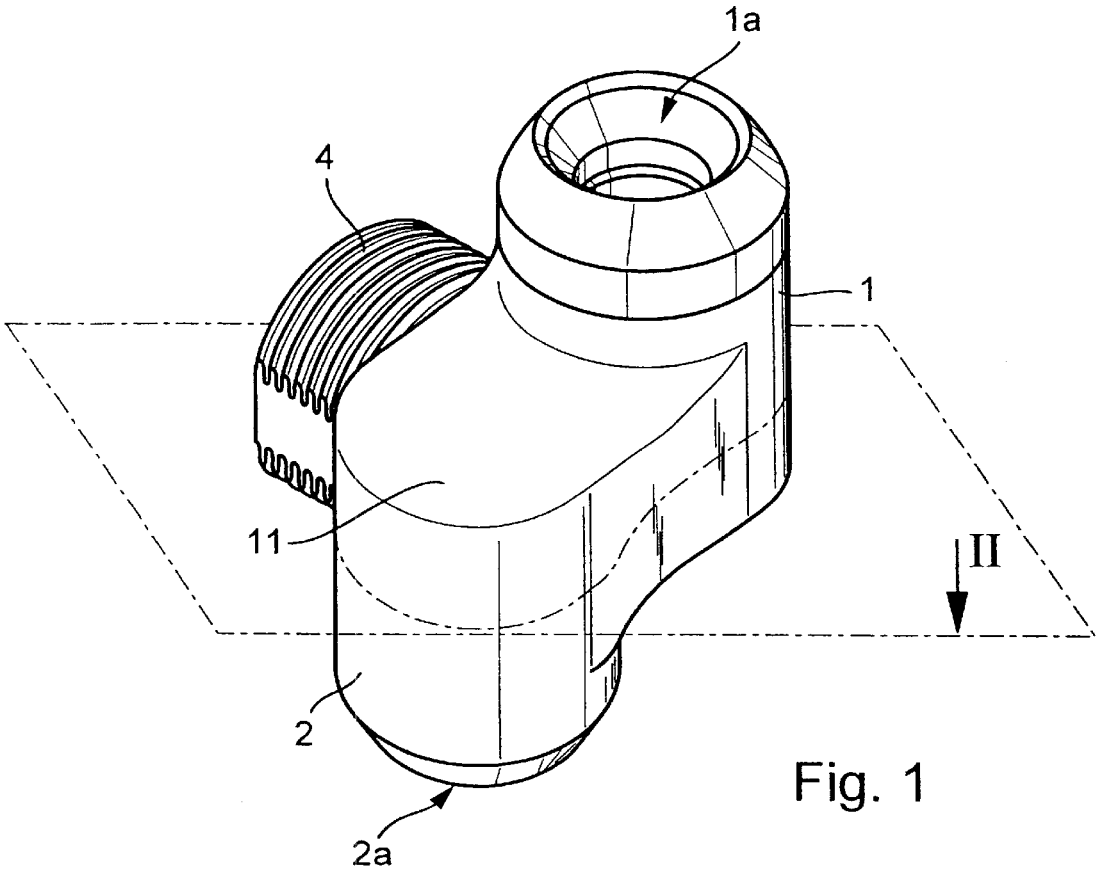
FIG. 1 is a perspective exterior view of a double-swirl spraying nozzle constructed according to a preferred embodiment of the invention.

FIG. 1 illustrates two housings 1 and 2 of a double-swirl spraying nozzle whose outlet openings 1*a* and 2*a* respectively point in opposite directions. As illustrated, these two housings 1 and 2 are arranged side-by-side and are connected by means of a joint feeding duct 3 with the medium to be sprayed. The feeding duct 3 is surrounded by a connection thread 4 which is not shown in detail in the cross-sectional view according to FIG. 2. This connection thread 4 can be connected with a connection flange but also with other connection devices.

Figure 2:
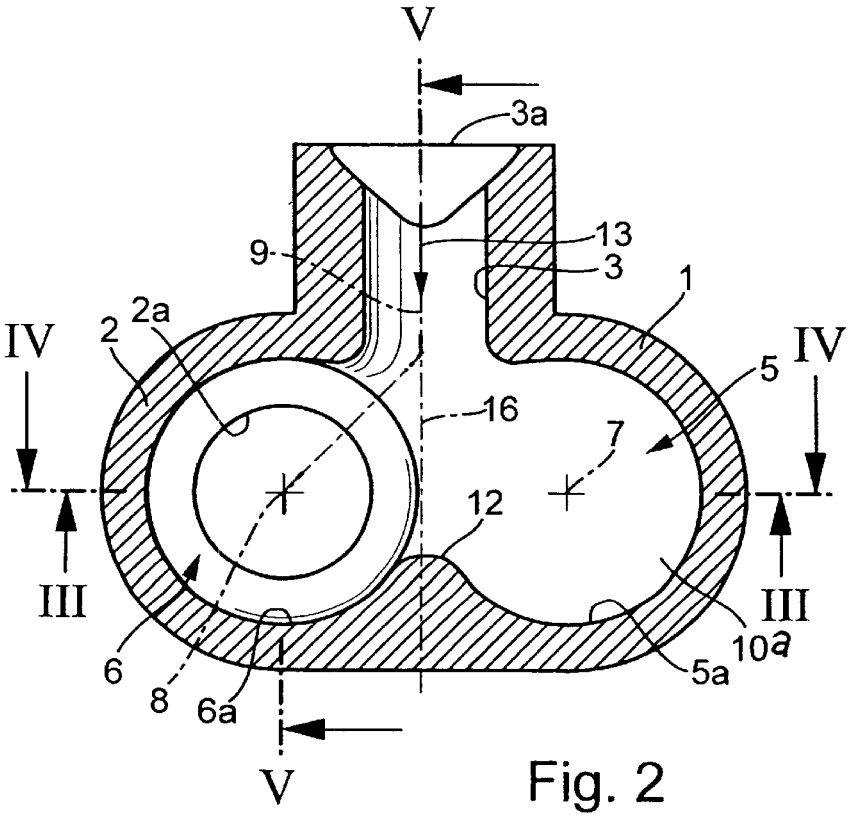
FIG. 2 is a sectional view in the direction of the sectional plane II—II according to FIG. 1.

FIG. 2 shows that the interiors 5 and 6 of the two swirl chamber housings 1 and 2 are each respectively arranged on both sides of a plane 9 extending through the center of the inflow duct 3 and parallel to the axes 7 and 8 of the swirl chambers 1 and 2. This plane 9 therefore touches both swirl chambers 5 and 6. In this case, the interior side 10A of the bottom 10 is visible in the interior 5, while the outflow opening 2*a* is visible of the swirl housing 2. In FIG. 1, the exterior side of the bottom 11 of the swirl chamber 2 extends upward.

Figure 3:
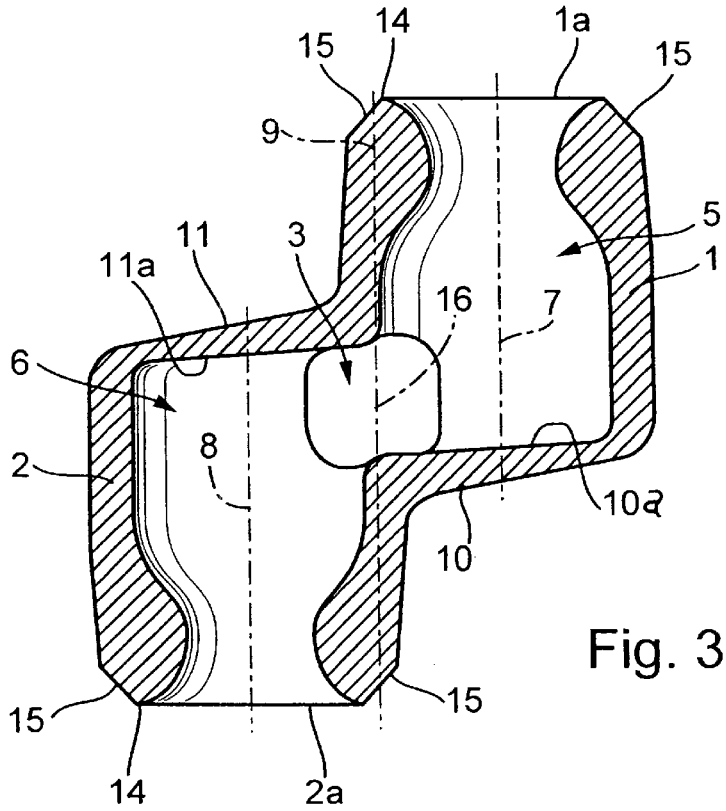
FIG. 3 is a cross-sectional view of the swirl spaces of the nozzle, viewed in the direction of the arrows III in FIG. 2.
Figure 4:
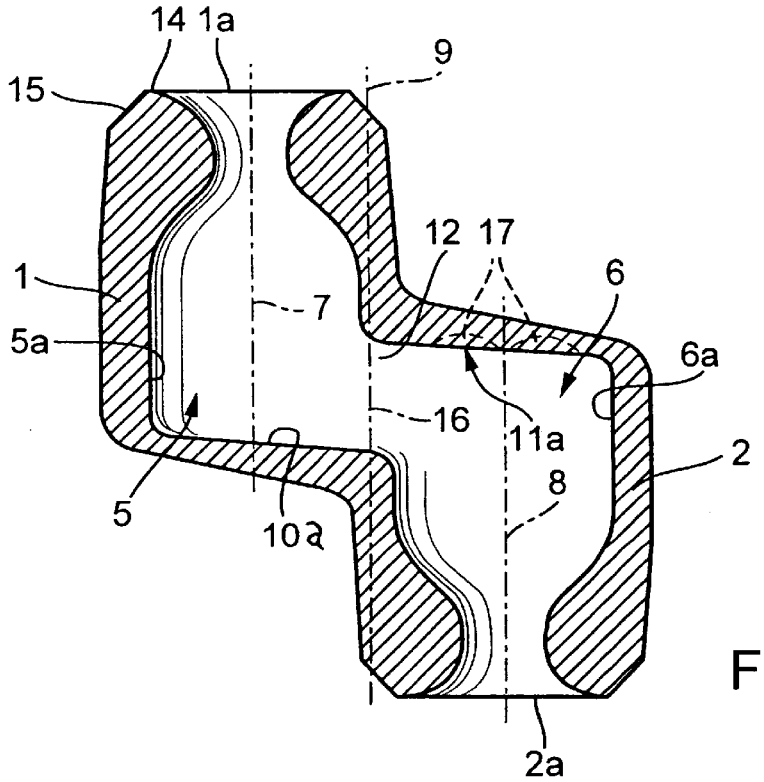
FIG. 4 is a sectional view of the swirl spaces of the nozzle according to FIG. 2 viewed in the direction of the arrows IV.
Figure 5:
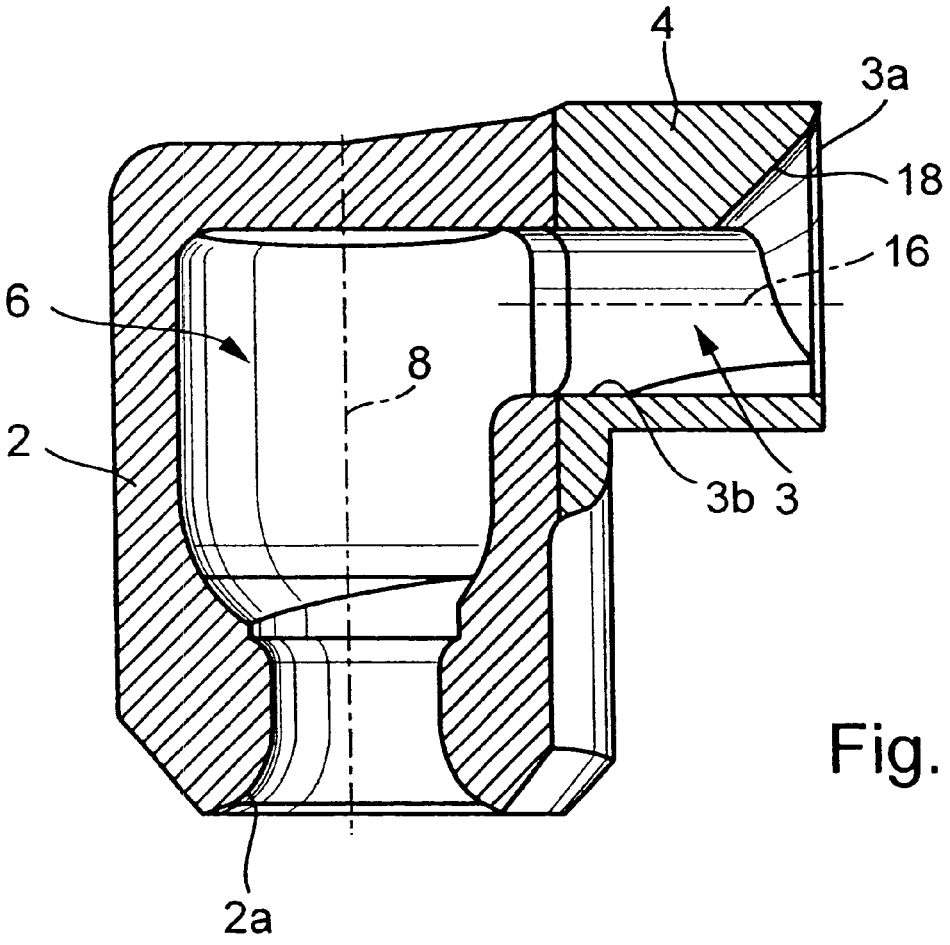
FIG. 5 is a sectional view of one of the swirl spaces along the intersection line V—V.

In the embodiment according to FIGS. 1 and 2, the two swirl chambers 1 and 2 and their interiors 5 and 6 are constructed to be mirror-inverted with respect to the longitudinal center plane 9 in the horizontal plane according to FIG. 2 extending through the center axis 16 of the inflow duct. This results in a nose 12, which is directed against the inflow and is in each case formed by a portion of the interior walls 5*a* and 6*a*, on the interior wall situated opposite the inlet side 3*a* of the feeding duct 3, which nose 12 is arranged symmetrically with respect to the longitudinal center plane 9 and is illustrated in FIG. 4. The media jet, which enters in the direction of the arrow 13 (FIG. 2), therefore impacts virtually as a full jet onto the opposite wall surfaces 5*a*, 6*a* and onto the nose 12 situated in-between and, in the embodiment shown, is divided into two partial flows of the same size but provided with an opposite swirl. A cross-sectional contraction does not take place anywhere. Thus, at the time of its entering, the full jet itself at first forms the separating wall between the two housings 5 and 6 and is then divided into two partial flows which flow out either upward—through the housing 1 as shown in FIG. 1—or in the opposite direction through the opening 2*a*. In this case, FIGS. 3 and 5 show very nicely that the inlet cross-section of the feeding duct is not constricted. The energy of the entering jet can therefore be divided completely into swirling energy and into the spraying jets which exit in the opposite direction.

As additionally shown by FIGS. 3 and 4, the bottom interior side 10A of the swirl chamber 5 is inwardly sloped diagonally to the axis 7 of this swirl chamber, which inversely is also true for the interior side 11*a* of the bottom 11 of the swirl housing 2. This measure has the effect that, when the nozzle is rendered inoperative, no residual liquid can remain standing in the housing which is open in the upward direction. This liquid can flow off in the downward direction through the second nozzle arranged in a laterally offset manner. However, FIGS. 3 and 4 also show that all exterior surfaces, for example, the upward-directed bottom 11 of the swirl housing 2, but also the exterior surface of the bottom 10 of the swirl housing 1 are also arranged diagonally with respect to the assigned swirl axis 7 and 8 respectively, so that medium, such a spraying liquid, which, as a result, impacts on the outside on the nozzle, can flow off unhindered to the outside.

FIG. 5 shows that a funnel-type opening in the form of an upward-extending widening 18 is provided on the inlet side 3*a* of the inflow duct 3. This widening forms a type of half-funnel because the bottom 3*b* of the inflow duct does not rise from the inlet side 3*a* to the swirl chamber 6. This further development ensures that, when the double-swirl spraying nozzle is switched off, no stagnating liquid remains also in the inflow duct 3. Residual liquid situated here also runs off by way of the swirl chamber 6.

In the embodiment shown, the two swirl spaces 5 and 6 are arranged and constructed in a mirror-inverted manner with respect to the center axis 16 of the inflow duct 3. In the case of the selected type of construction of the double-swirl nozzle, embodiments are also contemplated with the interiors 5 and 6 designed differently and such that different volume flows, different spraying angles and also different spraying jets can be achieved. Thus, for example, the bottom 11*a* of the swirl housing 2—or both bottoms of both swirl chambers—can be provided with recesses 17, as indicated by a broken line in FIG. 4. These recesses 17 can be arranged rotationally symmetrically with respect to the axis 8 or asymmetrically on the bottom 11*a*. They may have the effect that the entering liquid rotates not only on the assigned wall 6*a* but also in the interior of the swirl space. Full-cone jets can be generated in this manner. The nozzle is therefore suitable for many applications.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes.

2. Double-swirl spraying nozzle according to claim 1, wherein the interiors of both swirl chambers are arranged on different sides of the center plane.

3. Double-swirl spraying nozzle according to claim 2, wherein the inflow duct leads tangentially into both swirl chambers.

4. Double-swirl spraying nozzle according claim 2, wherein the swirl chambers are constructed in a sectional plane extending through the center axis of the inflow duct and perpendicular to the axes of the swirl chamber, in a mirror-inverted manner to the center plane.

5. Double-swirl spraying nozzle according to claim 1, wherein the inflow duct leads tangentially into both swirl chambers.

6. Double-swirl spraying nozzle according claim 5, wherein the swirl chambers are constructed in a sectional plane extending through the center axis of the inflow duct and perpendicular to the axes of the swirl chamber, in a mirror-inverted manner to the center plane.

7. Double-swirl spraying nozzle according to claim 1, wherein the exterior surfaces are constructed such that the impacting medium can flow off toward the outside.

8. Double-swirl spraying nozzle according claim 7, wherein the swirl chambers are constructed in a sectional plane extending through the center axis of the inflow duct and perpendicular to the axes of the swirl chamber, in a mirror-inverted manner to the center plane.

9. Double-swirl spraying nozzle according claim 1, wherein the swirl chambers are constructed in a sectional plane extending through the center axis of the inflow duct and perpendicular to the axes of the swirl chamber, in a mirror-inverted manner to the center plane.

10. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, and wherein the bottoms of the two swirl chambers are arranged to be sloped toward the assigned swirl chamber axis and respectively and the other swirl chamber respectively.

11. Double-swirl spraying nozzle according to claim 10, wherein the swirl chambers have different constructions for generating different spraying jets and spraying volumes.

12. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, wherein the interiors of both swirl chambers are arranged on different sides of the center plane, and wherein the bottoms of the two swirl chambers are arranged to be sloped toward the assigned swirl chamber axis and respectively and the other swirl chamber respectively.

13. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, and wherein the swirl chambers are constructed in a sectional plane extending through the center axis of the inflow duct and perpendicular to the axes of the swirl chamber, in a mirror-inverted manner to the center plane.

14. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, and wherein the swirl chambers have different constructions for generating different spraying jets and spraying volumes.

15. Double-swirl spraying nozzle according to claim 14, wherein the bottom of at least one of the swirl chambers is provided with indentations such that the liquid rotates not only on the assigned wall of the swirl chamber but also in the interior of the swirl chamber.

16. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, wherein the interiors of both swirl chambers are arranged on different sides of the center plane, and wherein the swirl chambers have different constructions for generating different spraying jets and spraying volumes.

17. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes wherein the inflow duct leads tangentially into both swirl chambers, and wherein the swirl chambers have different constructions for generating different spraying jets and spraying volumes.

18. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes wherein the exterior surfaces are constructed such that the impacting medium can flow off toward the outside, and wherein the swirl chambers have different constructions for generating different spraying jets and spraying volumes.

19. Double-swirl spraying nozzle having two swirl chambers which are open toward opposite directions for generating oppositely exiting spraying jets with an opposite swirl, and having a common inflow duct for the medium to be sprayed, wherein the center axes of the swirl chambers are arranged on different sides of a center plane extending through the inflow duct and parallel to the swirl chamber axes, and wherein one of the swirl chambers is open in a downward direction, and the level of the bottom of the inflow duct does not rise from the inlet side to the interior of the swirl chamber which is open in the downward direction.

20. Double-swirl spraying nozzle according to claim 19, wherein on the inlet side of the inflow duct, a widening in the form of a type of half-funnel is provided which extends asymmetrically with respect to the center axis of the inflow duct and is directed away from the swirl chamber which is open in the downward direction.

21. A method of spraying a fluid comprising:

supplying high pressure fluid to a spraying nozzle inflow duct, and splitting the inlet flow into two swirl chambers which are open toward opposite directions and generating respective opposite swirls in the swirl chambers, wherein the center axes of the swirl chambers are arranged on different sides of a center plane extending through the inflow duct and parallel to the swirl chamber axes.

22. A method according to claim 21, wherein the interiors of both swirl chambers are arranged on different sides of the center plane.

23. A method according to claim 21, wherein the inflow duct leads tangentially into both swirl chambers.

24. A method of spraying a fluid comprising:

supplying high pressure fluid to a spraying nozzle inflow duct, and splitting the inlet flow into two swirl chambers which are open toward opposite directions and generating respective opposite swirls in the swirl chambers, wherein the center axes of the swirl chambers are arranged on different sides of a center plane extending through the inflow duct and parallel to the swirl chamber axes, and wherein the bottoms of the two swirl chambers are arranged to be sloped toward the assigned swirl chamber axis and respectively and the other swirl chamber respectively.

* * * * *